United States Patent [19]

Lee et al.

[11] Patent Number: 4,980,973

[45] Date of Patent: Jan. 1, 1991

[54] SHAVER HAVING A CLIPPER

[76] Inventors: Chin-Piao Lee, No. 2, Lane 491, Jong-Jeng S. Rd., Yung-Kang Shiang, Tainan Shien, Taiwan; Edward P. Lee, 100 B. N. 3rd St., Alhambra, Calif. 91801

[21] Appl. No.: 486,210

[22] Filed: Feb. 28, 1990

[51] Int. Cl.[5] ..... B26B 19/06

[52] U.S. Cl. ..... 30/34.1; 30/29.5

[58] Field of Search ..... 30/29.5, 32, 34.1, 34.05, 30/85, 90

[56] References Cited

U.S. PATENT DOCUMENTS

| | | | |
|---|---|---|---|
| 2,764,811 | 10/1956 | Guardino | 30/29.5 |
| 2,783,533 | 3/1957 | Wilson | 30/90 X |
| 4,498,236 | 2/1985 | McIntyre et al. | 30/34.1 |
| 4,521,962 | 6/1985 | Van Natta | 30/29.5 X |
| 4,760,642 | 8/1988 | Kwak | 30/123 |

*Primary Examiner*—Douglas D. Watts

*Attorney, Agent, or Firm*—Bacon & Thomas

[57] ABSTRACT

A shaver having a clipper comprises a single elongated handle with one end detachably connected with a shaving unit and the other end connected with a clipper adapted for trimming user's nose hair by inserting an indented end into the user's nose and trimming the hair therein through a smooth operation.

1 Claim, 2 Drawing Sheets

SHAVER HAVING A CLIPPER

BACKGROUND OF THE INVENTION

This invention relates to an improved shaver, and more particularly to a shaver having a clipper for clipping or trimming nose hairs.

Conventionally, shavers can serve only one function of shaving. The shaver who wants to trim his nose hair after shaving a scissors of which the sharp blade edges or pionts may hurt internal skin of his nose. To this end, the inventor has attemped to make an improved shaver to overcome the drawbacks of a known shaver.

SUMMARY OF THE INVENTION

An object of this invention is to provide an improved shaver which can diminish the disadvantages of a known shaver.

It is another object of this invention to provide a shaver having a clipper for clipping or trimming nose hair.

With the above objects in view, this invention provide an improved shaver which comprises an elongated handle with one end thereof detachably connected with a shaving unit and the other end connected with a clipper having an indented end adapted to be inserted into user's nose for trimming hair therein through a smooth operation.

DETAILED DESCRIPTION OF THE PREFERRED EMBODIMENT

Figure 1:
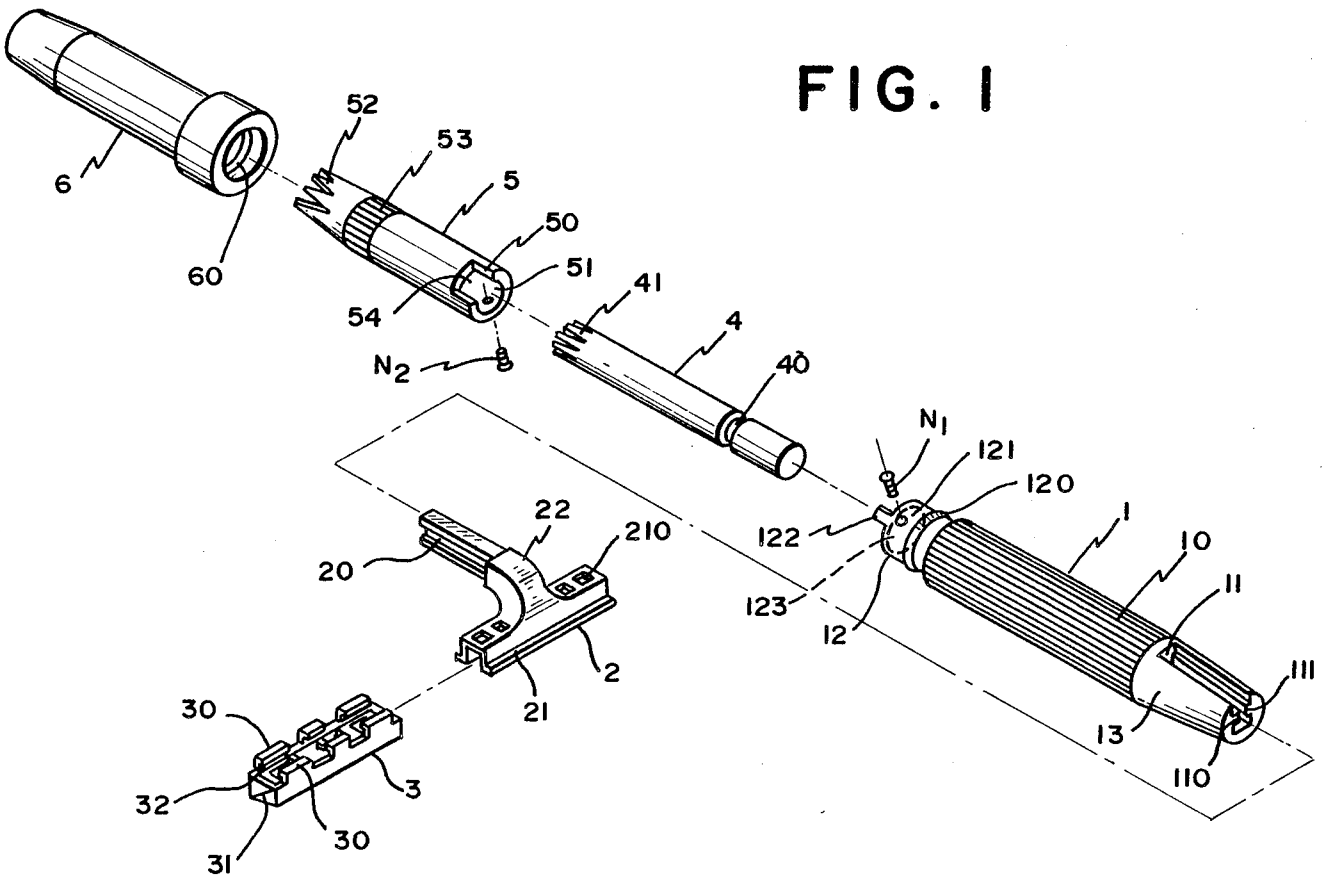
FIG. 1 is an exploded perspective view of the preferred embodiment of this invention.
Figure 2:
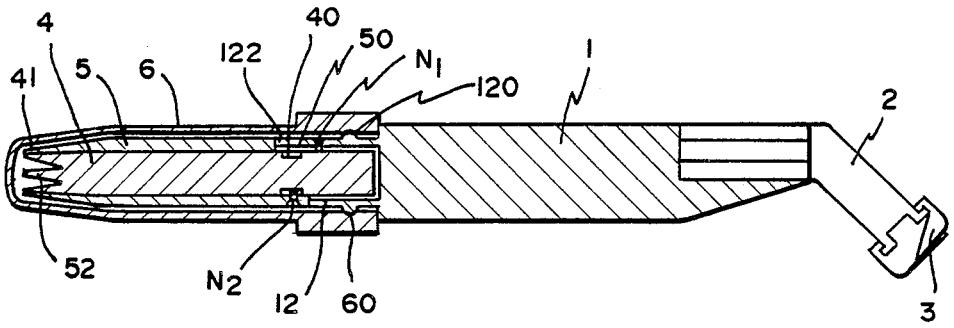
FIG. 2 is a cross-sectional view of the shaver of this invention.

As shown in FIGS. 1 and 2, a shaver having a clipper according to this invention comprises a handle 1 of cylindrical shape having a roughened surface 10 and a conical joint 13 to which is telescopically connected a razor assembly. In order to detachably connect the razor assembly, the joint 13 of the handle 1 is axially formed with a slot 11 formed with opposite rails 110, 111 which interfit with respective grooves 20 formed at the end of the razor assembly.

The razor assembly includes a head 2 having a track 21 which is brought into engagement with a shaving unit or blade unit 3 by sliding the track 21 into a longitudinal groove 32, which is defined by aligned and bent projections 30 in the rear of the shaving unit 3. The head 2 has a neck 22 projecting substantially perpendicular to the head and having its end segment, which is formed at opposite sides with the two grooves 20, being bent at an obtuse angle with respect to the remaining neck segment. By so doing, when the shaving unit 3 is attached to the handle 1 and the handle 1 is held in the normal way by the user, the shaving unit 3 is oriented at the correct shaving angle relative to the skin surface so that the shaver can shave with a blade 31 retained therein to obtain a close shave. The head 2 of the razor assembly is formed with a plurality of usual drain openings 210, as shown in FIG. 1, to facilitate flushing and rinsing the blade edge after use.

At the opposite end of the handle 1, there is formed with a socket 12, of which a side wall defining a recess

123, for receiving a clipper. The side wall of the socket 12 is formed with a screw hole 121 communicating the recess 123. Said clipper comprises an inner cylindrical body 4 and a sleeve 5 turnably mounted on the cylindrical body 4. Said cylindrical body 4 has an indented end 41 and a groove 40 circumferencially formed in a side wall thereof. An end portion of the body 4 opposed to the indented end 41 is inserted into the recess 123 of the socket 12 and retained therein by threading a screw N1 through the screw hole 121 with the inner end of the screw N1 frictionally abutting against the end portion of the body 1 within the recess 123. The sleeve 5 has an inner passage 54 running therethrough for turnably housing the cylindrical body 4, an indented end 52, a roughened section 53 formed in the side wall for facilitating trimming operation with fingers and a slot 50 in the side wall from the end opposed to the indented end 52 thereof. A screw hole 51 is formed in the side wall of the sleeve 5 at the same end as the slot 50 for threading inwardly a screw N2 which, as it is threaded through the screw hole 51 with its leading end protruding into the inner passage 54, serves as a guider allowing only rotation movement of the sleeve 5 relative to the cylindrical body 4 as the sleeve 5 houses the body 4 and the screw N2 is engaged in the groove 40 of the body 4.

The socket 12 is further formed with a stopper 122 extending into the slot 50 of the sleeve 5 as the clipper is in an assembled state for limiting the rotation movement of the sleeve 5 within a proper range by abutting against either one of the opposed side walls defining the slot 50. A protective cover 6 is provided for housing the clipper by means of a firm engagement between an internal groove 60 formed in an inner side wall of the cover 6 and a lug 120 circumferencially formed on the outer side wall of the socket 12 which are sufficient flexibility to allow engagement and disengagement therebetween.

Figure 3:
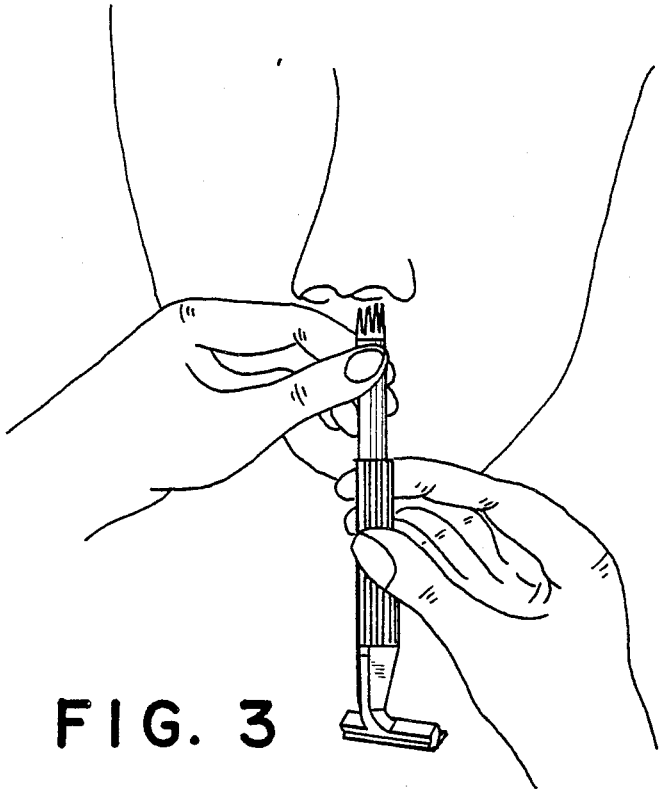
FIG. 3 is a diagramatic view showing a trimming operation of an user's nose hair.

In trimming operation, as shown in FIG. 3, the user cautiously inserts the indented end of the clipper into his nose and turns the sleeve 5 alternatively in clockwise and counterclockwise directions for trimming nose hair therein within the preset range that will cause only a smooth operation for preventing any hurt to the skin thereof. Therefore, it is intended that all matter contained in the above description or shown in the accompanying drawing be interpreted as illustrative and not in a limiting sense. It is also to be understood that the following claim are intended to cover all of the generic and specific features of the invention herein described.

What is claimed is:

1. A shaver having a clipper comprising:

an elongted handle formed with a roughened surface;

a shaving assembly mounting at least a blade having at least an edge for shaving and an elongated neck extending perpendicular to the blade;

a securing means for securing one end of the neck of the shaving assembly to an end of the handle by which the shaving assembly may be held during shaving;

a socket member attached to another end of the handle opposite to the shaving assembly and having a side wall formed with a first screw hole and defining a recess;

a clipper having an elogated body formed with an indented end and a circumferencial groove, one end of the body opposite to the indented end being inserted into the recess of the socket member, and a sleeve rotatably housing the body and formed with an indented end and a slotted end opposite to the indented end and formed with a second screw hole;

a first screw threaded through the first screw hole into the recess for frictionally retaining the elongated body inserted in the recess in position;

a second screw threaded through the second screw hole into the circumferencial groove of the elongated body for restricting the sleeve to move in rotation relative to the housed inner body of the clipper;

a stop means projecting from the side wall of the socket member and extending into a slot of the slotted end of the sleeve for limiting the rotation movement between the sleeve and inner body of the clipper; and a protective cover adapted for housing the clipper and having an open end frictionally mounting on the side wall of the socket member.

* * * * *